United States Patent [19]

Cooksey

[11] 4,041,929

[45] Aug. 16, 1977

[54] COMPOSITE FIREPLACE CONSTRUCTION

[76] Inventor: Jonathan Norton Cooksey, 3041 Kallin, Long Beach, Calif. 90808

[21] Appl. No.: 548,786

[22] Filed: Feb. 10, 1975

[51] Int. Cl.[2] ..... F24B 1/18

[52] U.S. Cl. ..... 126/120; 126/130; 126/142; 126/144; 110/1 A; 432/249

[58] Field of Search ..... 126/120, 142, 144, 130, 126/121; 110/1 A; 122/6 A; 432/247, 249; 427/244

[56] References Cited

U.S. PATENT DOCUMENTS

| | | | |
|---|---|---|---|
| 2,707,464 | 5/1955 | Gillen | 126/121 |
| 2,821,975 | 2/1958 | Thulman | 126/120 |
| 3,301,249 | 1/1967 | Hendricks | 126/120 |
| 3,460,525 | 8/1969 | Bryant | 126/120 |
| 3,778,304 | 12/1973 | Thompson | 427/244 |

FOREIGN PATENT DOCUMENTS

| | | | |
|---|---|---|---|
| 793,824 | 4/1958 | United Kingdom | 126/120 |

*Primary Examiner*—Kenneth W. Sprague
*Assistant Examiner*—Larry I. Schwartz
*Attorney, Agent, or Firm*—George W. Finch

[57] ABSTRACT

A molded fireplace construction whose firebox has an outer wall comprised of a mixture of magnesium oxychloride, organic resin and a fiber reinforcement such as fiberglass, an inner refraction liner of slate dust and magnesium oxychloride and an insulator therebetween comprised of magnesium oxychloride, expanded mica or slag and microballons. The completed construction has an inner liner resistant to abrasion and heat, an effective insulating layer and an outer structural layer which can be decorative or merely functional. In the exhaust system for the firebox, the outer two layers can be used without the inner refractory layer. The fireplace construction is fabricated for easy assembly and replacement of portions thereof should that ever be required.

15 Claims, 12 Drawing Figures

36
166
36
164
40
38
34
23
32'
42
46
159
22
89
146
32
54'
26
150
148
42
44
30
30
90
20
28
25
50
52
48
24
57
54
56

FIG. 9
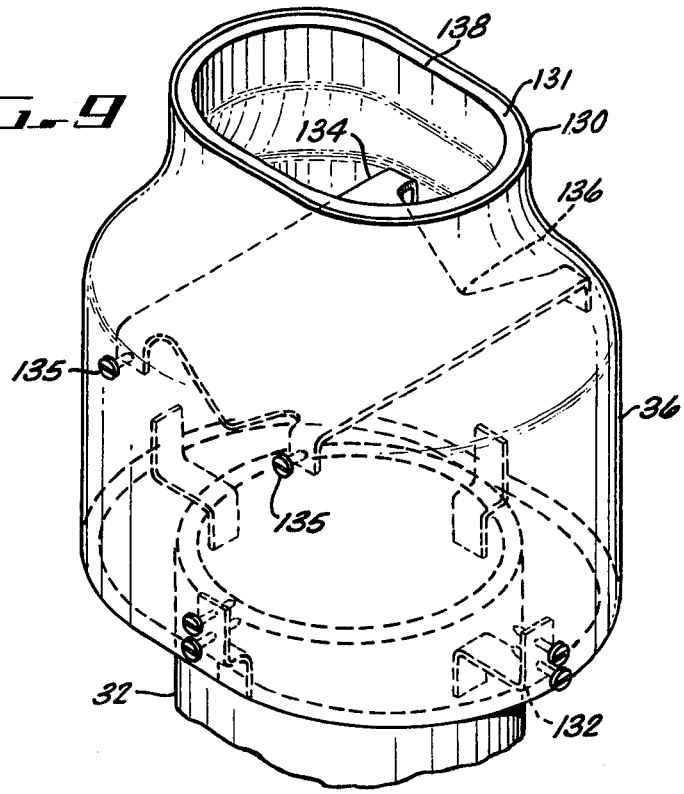
FIG. 10
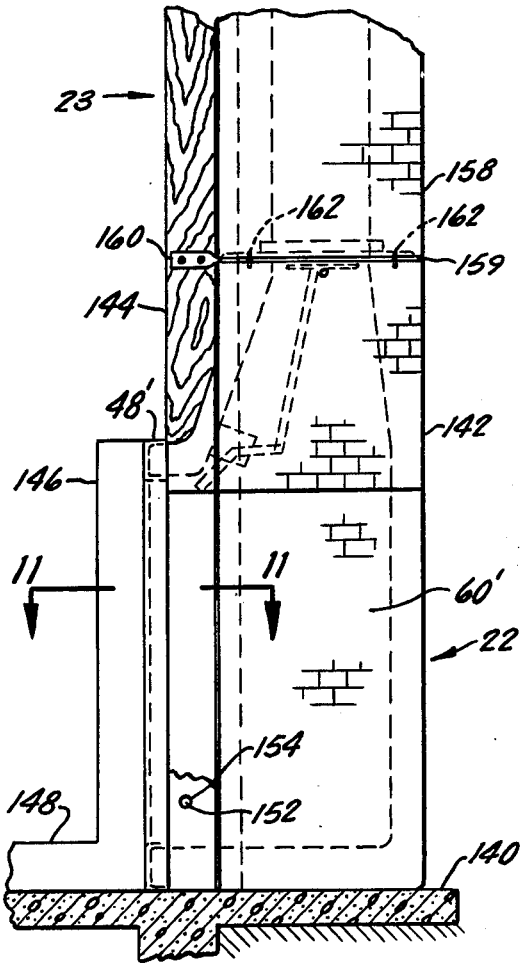
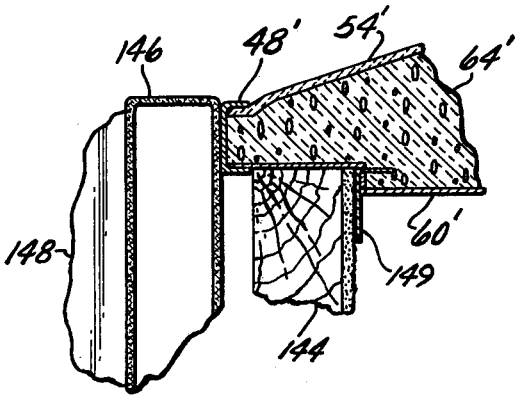
FIG. 11

COMPOSITE FIREPLACE CONSTRUCTION

CROSS REFERENCE TO RELATED PATENTS

U.S. Pat. No. 1,429,451 suggests the introduction of porosity into magnesium oxychloride cement by intermixing cork or other like material into the cement and thereafter decomposing the particles. U.S. Pat. No. 1,372,118 discloses that building boards and roofing material can be made from magnesium oxychloride cement in a foraminous support. U.S. Pat. No. 1,500,207 discloses a magnesium oxychloride cement surface resembling ornamental stone coated on fiberboard and U.S. Pat. No. 3,050,427 discloses the use of fiberglass with magnesium oxychloride cement as its binder. In addition, U.S. Pat. No. 3,778,304 which was issued to Henry C. Thompson, Dec. 11, 1973, discloses suitable structural mixtures for providing magnesium oxychloride cement specifically in fireproofing applications. Reference is made to the information in this latter patent entitled "Magnesium Oxychloride Fireproofing" as though fully set forth hereinbelow.

BACKGROUND OF THE INVENTION

Since early recorded history, fireplaces have been made by skilled workers of masonry construction, which must be accomplished at the building site. In modern home construction, however, masonry has become relatively expensive and time consuming. Also, masonry fireplaces are notorious heat wasters since a large quantity of the heat is absorbed in the bricks and is lost. Therefore, metal stoves and furnaces have come into general use in most modern homes to provide the normal heating requirements with fireplaces being relegated to decorative purposes only. As labor and the use of borrowed construction funds have become more expensive, it has been found that even as a decorative feature, a masonry fireplace is prohibitively expensive and therefore metal fireplaces have been developed to simulate and/or replace the masonry fireplaces. Unfortunately, metal fireplaces tend to be heavy and rather bulky to assure that no hot portion of the fireplace is ever in contact with a flammable portion of the home. Also, the price of steel, like labor, has climbed to the point where cheaper alternatives which require less room and are easier to install have been desired.

SUMMARY OF THE INVENTION

While fireplaces have become more and more expensive with the passage of time, materials such as magnesium oxychloride cement have been perfected such as is taught in the above referenced THOMPSON patent. The strength and fire resistant characteristics of such cement now make it a prime candidate for use in constructing composite fireplaces.

Magnesium oxychloride cement is commercially available under the name Norgan from Thompson Chemicals, Inc., Palo Alto, Calif. The cement comes in a brine of magnesium chloride having a specific gravity in the range about 22° Baume or four to five pounds of $M_gCl_2.6H_2O$ to a gallon of water. Other ingredients such as up to 3% by weight, magnesium sulphate can also be present. The second part of the Norgan is magnesium oxide powder. Five to seven pounds of magnesium oxide are normally added to a gallon of the magnesium chloride brine to form a satisfactory cement although different percentages can be used if the strength properties of the resulting product are not critical since the literature shows that the strength of such cement is seriously diminished when more or less magnesium oxide is added.

Frothing agents such as Norgan expander, also sold by Thompson Chemicals can be used in a mixture with the magnesium oxychloride cement to produce small bubbles within the cement which reduce the density thereof. When such cement is molded, the expander assures that the molds contains no voids. Suitable frothing agents include powdered magnesium and optionally an acid such as lactic acid which increases the bubbling action of the magnesium powder. Since the reaction between acid and the magnesium powder is exothermic, it tends to increase the temperature of the mixture which speeds the cure time of the cement.

The present multi-layer composite fireplace construction has interior walls and a floor lined with replaceable refractory sheets comprised of slate dust and oxychloride cement. The interior walls so constructed have a high resistance to abrasion and impact and a low thermal absorption coefficient. Behind the refractory lining is an insulating layer comprised of the magnesium oxychloride cement, expanded mica or slag known as vermiculite or perlite and optionally microballons. Such a combination is fireproof, strong and is so efficient that less than 2 inch (5.08 cm) thickness thereof is sufficient to insulate the fireplace so well from its surroundings that a no clearance is required between the outer shell of the fireplace and flammable materials. The outer shell of the fireplace is made from a layer of the cement, one or more organic resins and a fiber reinforcement such as fiberglass. The outer shell may be decorative or merely functional.

The end result is a fireplace having a wall thickness as in the range of 3 inches (7.62 cm) rather than the 5 inches (12.70 cm) required for metal fireplaces of the same type. At the same time, when proper portions of microballons are mixed in the insulating layer, the firebox can weigh one third as much as a metal box. This means that two persons can set up the fireplace in new home construction without requiring forklifts or other hoisting apparatus. It also means the fireplace can be shipped for much less due to its lower volume and weight and since the construction is relatively resistant to impact it does not need much shipping protection. Therefore, it can be shipped in thinner and lighter containers than are feasible for metal fireplaces. This makes unpacking the firebox on the building site easier and less time consuming, a definite advantage because it is highly desirable for tract contractors to have their workers install as many fireboxes as they can in a short length of time. This is true even though the present fireplaces do not require highly skilled and highly paid workers such as stonemasons, bricklayers, and sheet metal workers that are required in the previous metal and masonry fireplace constructions. At the same time, with present day prices, the fireplace can be constructed for about one half the cost of a comparable metal fireplace.

Since all of the layers making up the fireplace can be molded, any kind of design such as stone, brick or the like can be molded into the surfaces thereof as they are being constructed. In addition, by placing dye into the cement which is normally white, the surface can be permanently tinted to provide any pleasing decorative appearance that is desired.

The fireplace is made in standard components which are designed to fit together and to solve just about any construction problem up to and including the chimney top. The fireplaces can be made free-standing, can be hidden in a wall or can extend through a thin wall to run up the outside of the building and simulate a masonry fireplace giving architects wide latitude in their design possiblities.

It is therefore an object of the present invention to provide a fireplace construction which is easy to install, is heat efficient and is relatively economical.

Another object of the present invention is to provide a composite molded fireplace construction.

Another object is to provide a decorative fireplace which requires zero clearance to the surrounding structure.

Another object is to provide a three-element construction utilizing a suitable cement such as magnesium oxychloride which sets up in a reasonable length of time and which is absolutely fireproof.

Another object is to reduce the cost of fireplaces in conventional home construction.

These and other objects of the present invention will become apparent to one skilled in the art after considering the following detailed specification which covers preferred embodiments thereof in conjunction with the accompanying drawings wherein.

BRIEF DESCRIPTION OF THE DRAWINGS

FIG. 9 is a perspective view of the rain cap for the lower fireplace of FIG. 1;

FIG. 10 is a side elevational view of the upper fireplace of FIG. 1;

FIG. 11 is a detail cross-sectional view taken at line 11—11 of FIG. 10; and

DETAILED DESCRIPTION OF THE SHOWN EMBODIMENTS

Figure 1:
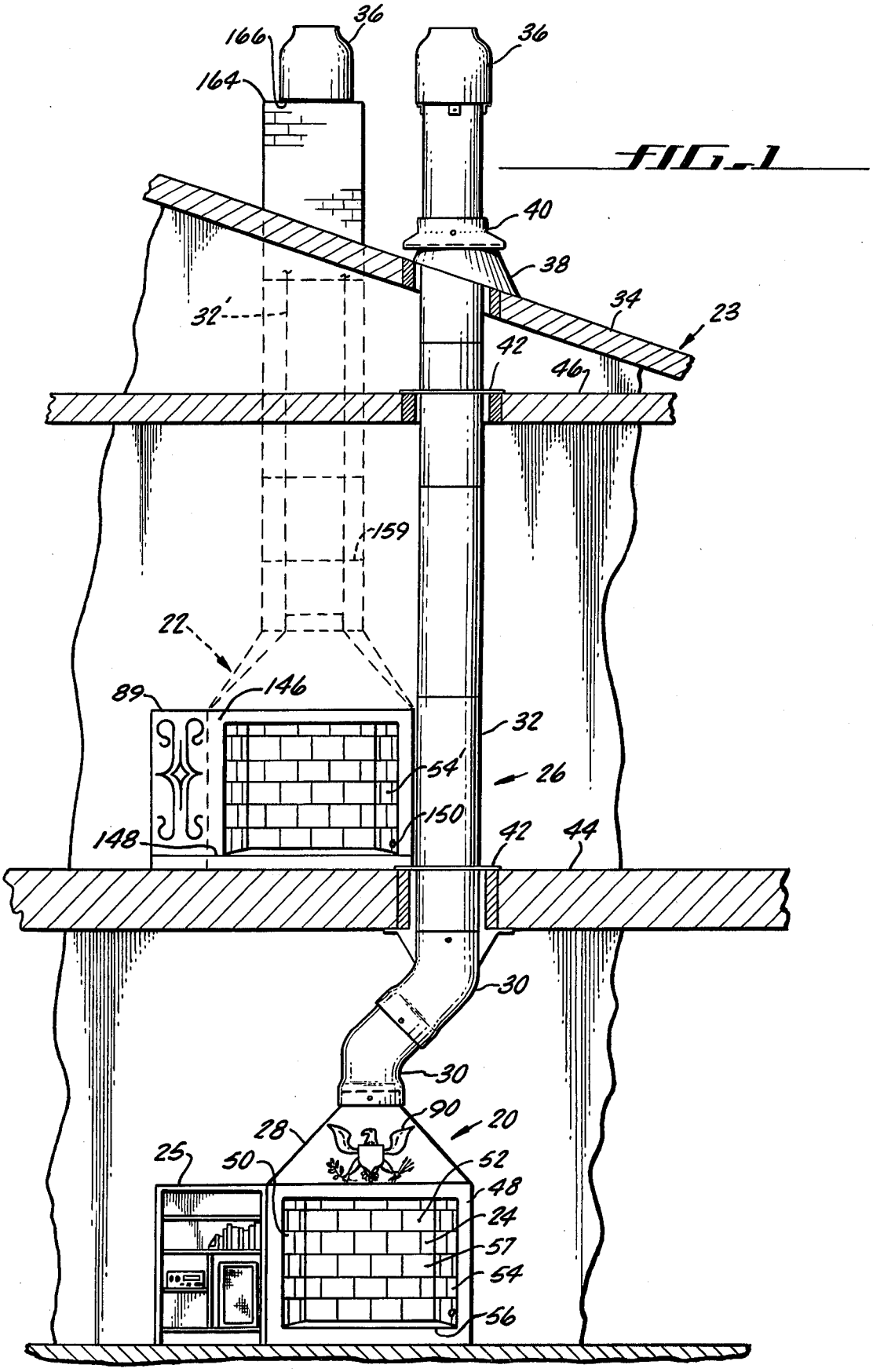
FIG. 1 is an elevational view of a portion of a home having two different composite fireplaces constructed according to the present invention.

Referring to the drawings, more particularly by reference numbers, numbers 20 and 22 refer to fireplace constructions constructed according to the present invention shown installed in the home 23. The lower fireplace 20 is typical of the free-standing fireplaces or fireplaces with adjacent cabinetry 25. It includes a firebox 24 for containing a fire, a chimney 26 for conducting exhaust products from the fire out of the house 23 and a hood 28 for connecting the chimney 26 to the firebox 24. As can be seen, the chimney 26 is constructed from elbow pipe 30 and straight pipe 32 and extends through the roof 34 and terminates at an end cap 36. Suitable means such as flashing 38 and a storm collar 40 are provided at the point the chimney 26 extends through the roof 34 to prevent water, rodents and other undesirable elements from entering through the roof 34 at that point. They also assist in supporting the chimney 26 with respect to the roof 34. Other support means such as firestops 42 constructed in a conventional fashion from sheet metal are also provided to support the chimney 26 as it passes through the floor 44 and the ceiling 46 of the house 23. Firestops 42 and other such supporting means are conventional features found in most non-masonry fireplace systems.

Figure 2:
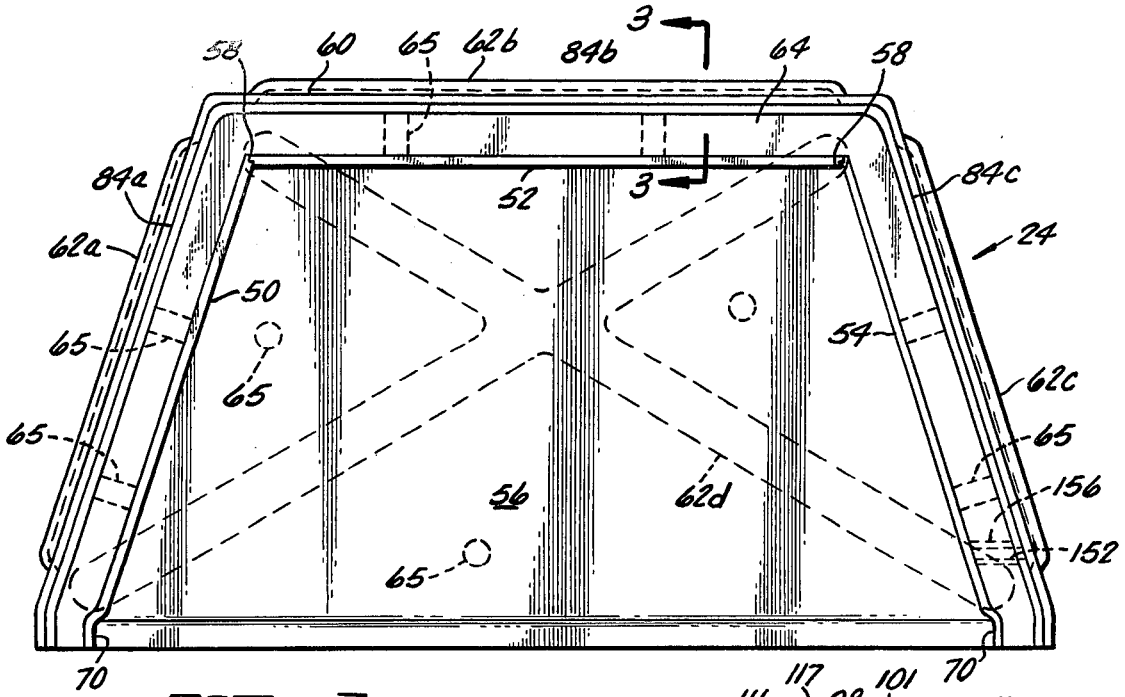
FIG. 2 is a top view of the firebox of the lower fireplace of FIG. 1.

The construction of the firebox 24 is shown in detail in FIGS. 2 through 5, and 7. FIG. 2 is a top view of the firebox 24 disassembled from its hood 28 and hearth facing 48.

The firebox 24 is of a three-layer construction whose inner refractory layer is comprised of four molded sheets, 50, 52, 54 and 56 of magnesium oxychloride cement and slate dust. Typically, these layers are about ⅜ inch (.97 cm) thick. The sheets 50, 52, 54 and 56 have the ability to absorb thermal shock and to resist the impact and abrasion that normally accompanies the operation of a wood burning fireplace. The sheets 50, 52, 54 and 56 are constructed from about 50 to 70% slate dust by weight with 60% being optimal for most conditions with a remaining weight being made up of the magnesium oxychloride cement such as Norgan and 2% Norgan Expander. Norgan Expander, as aforesaid, is a foaming agent which forms small gas bubbles in the mixture. The bubbles assist in filling the molds used to form the sheets 50, 52, 54 and 56 and keep the slate dust and the cement in a generally homogenous mixture while the cement sets. The finished product is a hard and strong refractory material having a low coefficient of heat absorption, a high resistance to thermal or impact shock and an ability to retain molded features such as the pseudo masonry design 57. The sheets 50 and 54 for the sides, sheet 52 for the back wall, and sheet 56 for the floor of the firebox 24 are molded as individual relatively flat pieces. As can be seen, interlocking means such as grooves 58 are provided at the edges of the sheets 50, 52, 54 and 56 so they interlock and are relatively self-supporting when installed in the firebox 24 with their appropriate facing 48.

The outer shell 60 of the firebox 24 is a single piece molded structure which is constructed from fiberglass and a mixture of about ⅔ by weight magnesium oxychloride, up to about 5% by weight and acrylic, and about ⅓ by weight polyester resin. A suitable commercial product of this type is sold under the tradename Polymag by Firex Co. of Calif. The polyester resin gives the final product a desirable resilience while the acrylic contributes to the resilience and helps protect the fireplace from weather and ultraviolet radiation. Other organic resins such as epoxy resin are also suitable since they are essentially fireproof when mixed as stated with the cement. The outer shell 60 provides a strong structural outer cover for the firebox 24 and may be dyed and molded for any desired decorative purposes or it may include structural reinforcement such as the XS 62*a*, *b*, *c* and *d* shown molded in the outer surfaces thereof. The X 62*d* also provides a skid to allow easy installation of the firebox 24. A shell 60 of ⅛ inch (.46 cm) thickness is all that is normally required for strength, however, some decorative treatments such as simulated used brick structures are as thick as ¼ inch (.92 cm). Once the shell 60 has been molded in appropriate tooling and allowed to cure, an insulating layer 64 is molded therein either by employing removable tooling which is the size and the shape of the assembled refractory lining sheets 50, 52, 54 and 56 or by using the refractory sheets installed and supported by means such as the plugs 65. The plugs 65 are preferably constructed from the same materials as the insulating layer 64, described below.

The insulating layer 64 is comprised of at least 25% by weight magnesium oxychloride and optionally up to about 10% by weight microballons which are used to lighten the structure as well as for their insulating qualities. The percentage of microballons must be limited, however, because they tend to weaken the structure. They are also relatively expensive. Up to 5% calcium carbonate, silica flour or Norgan Expander can be used as means to accelerate the cure time of the cement to keep the components in a relatively homogenous mixture and to assure complete mold filling. The remainder of the layer 64 is comprised of suitable insulation material such as expanded mica or slag sold as vermiculite and perlite. This type of insulating layer 64 is absolutely fireproof and is highly efficient so that rarely is a layer wider than 2 inches (5.08 cm) required. In addition, as will be shown, the layer 64 is a relatively strong structure and can be used in an unlined condition where severe impact such as the dropping of logs and firetools is not expected.

Once the insulating layer 64 has cured in the shell 60, the firebox is complete if the layer 64 was found with the sheets 50, 52, 54 and 56 since the insulating layer cure binds the structure together. Otherwise the tooling is removed from the inside of the layer 64 and the sheets 50, 52, 54 and 56 are installed in the interlocking fashion discussed above. It is then possible to adhesively bind the sheets 50, 52, 54 and 56 together and to the insulating layer 64 with the magnesium oxychloride cement. The adhesive is not required and is not used when it is desired to make the individual sheets 50, 52, 54 and 56 easily replaceable. The sheets are locked in position by the facing 48. The facing 48 can be molded as a unitary rectangular member having a U-shaped cross section as shown whose inner portions 66 and 68 are glued with the magnesium oxychloride cement to the shell 60 and an offset flange portion 70 of the sheets 50, 54 and 56.

Figure 3:
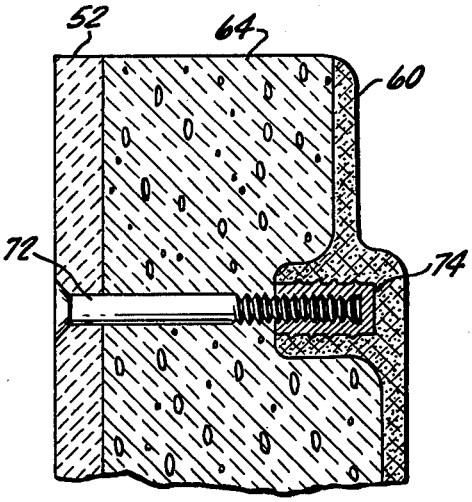
FIG. 3 is a cross-sectional view of a portion of the wall structure of FIG. 2 taken on line 3—3.

To provide assurance that the composite firebox structure stays together, bolts, such bolt 72 shown in FIG. 3 can be provided which extend through the slate layers such as layer 52 and the insulating layer 64 into an insulating blind nut 74 embedded in the shell 60. Such means are optional, however, since in most environments the interlocking nature of the sheets 50, 52, 54 and 56 and the facing 48 plus the adhesion to the insulating layer 64 is sufficient to maintain the sheets in their proper positions.

Figure 4:
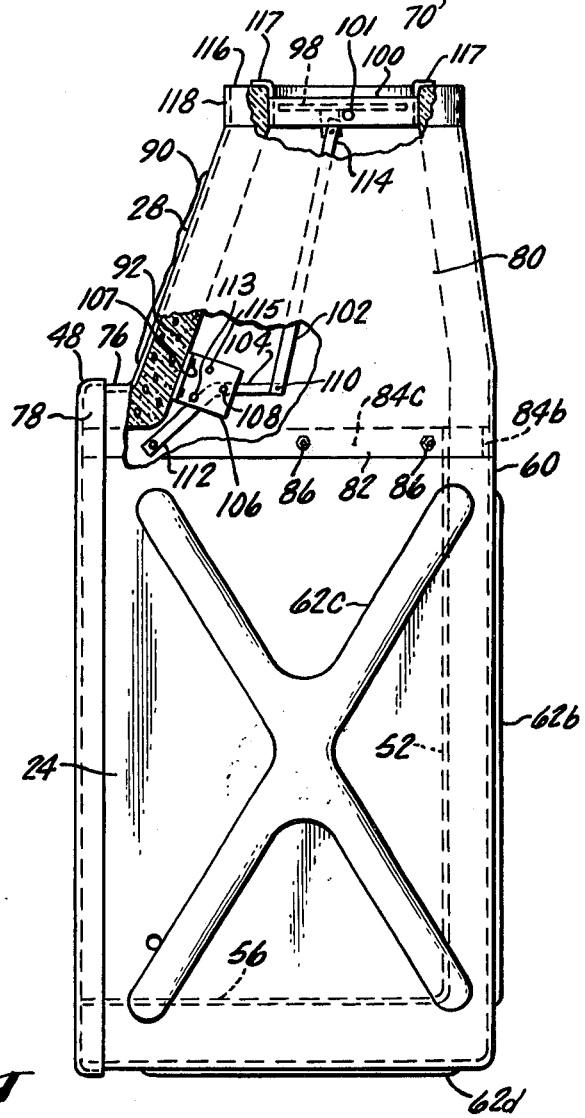
FIG. 4 is a side elevational view partially in cross-section of the firebox, hood and damper of the lower fireplace of FIG. 1.
Figure 5:
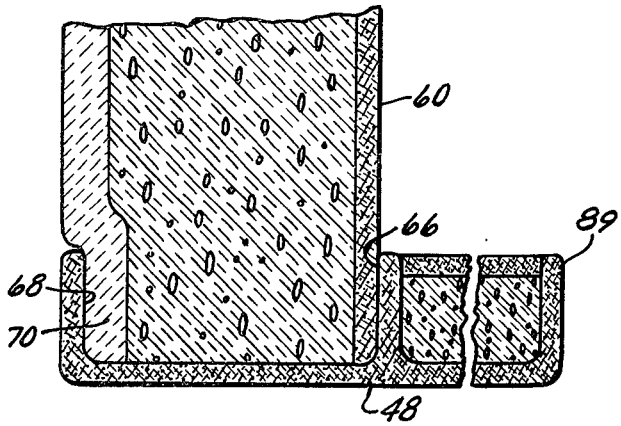
FIG. 5 is a cross-sectional view of a portion of the firebox of FIG. 4 taken on line 5—5.
Figure 6:
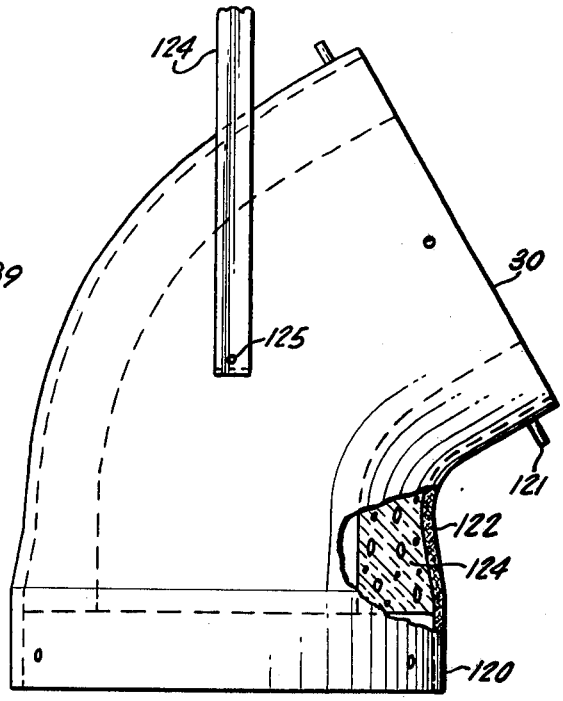
FIG. 6 is a side view partially in cross section of the exhaust pipe for the hood of FIG. 4.

As can be seen in FIG. 4, the facing 48 also forms part of the means to attach the hood 28 to the firebox 24. The facing 48 engages a frontwardly extending horizontal surface 76 and similar vertical portions 78 of the shell 80 thereof. The shell 80 of the hood 28 also has vertical portions 82 which extend down over the firebox shell 60 adjacent vertical offset flanges 84*a, b* and *c* thereof. Bolts 86 and blind nuts 88 as well as the magnesium oxychloride cement can then be used to fasten the portions 82 to the flanges 84 of the shell 60. The bolts 86 and cement are used to assure that undesirable movement between the hood 28 and the firebox 24 does not occur. In most installations, the portions 82 extend around three sides of the firebox 24 and along with the facing 48 assure that no relative lateral movement occurs therebetween.

The facing 48 is normally constructed from the same materials as the shell 60 with magnesium oxychloride cement being used to hold it in place. Where building codes demand, the facing 48 can include the extension 89 (FIG. 5) which may be decorative as shown with fireplace 22 in FIG. 1. The extension 89 can be insulated as shown with material like insulating layer 64.

The outer shell 80 of the hood 28 can be molded from the same materials used to construct the shell 60 of the firebox 24. Since it is molded, a decorative design 90 can be permanently built into it.

Figure 7:
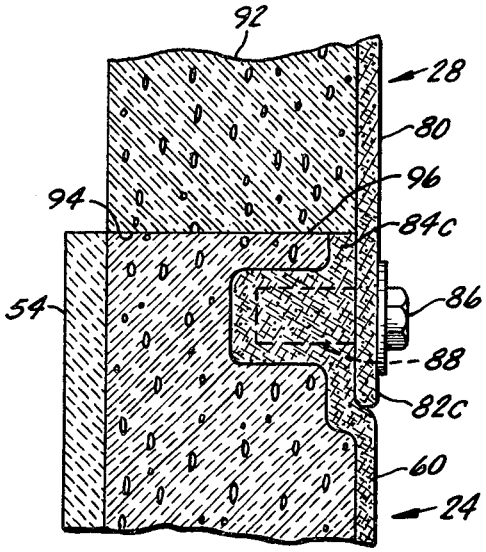
FIG. 7 is a cross-sectional view of the joint between the hood of the fireplace of FIG. 4 and the pipe of FIG. 6.

It should be noted that since heavy impact is not normally expected in the interior of the hood 28, a liner of refractory material is not required since the insulating layer 92, made like layer 64, is tough enough to resist the combustion products of the items normally burned in fireplaces. As shown in FIG. 7, the lower edge 94 of the insulating layer 92 rests on the upper edge 96 of the insulating layer 64 of the flange 84 so that even without the bolts 86, the force of gravity assures that the hood 28 and the firebox 24 do not move in a longitudinal direction with respect to each other.

The hood 28 includes a damper assembly comprised of the damper 98, damper support ring 100, a damper pivot 101, an actuation rod 102, a lever handle 104, and a handle support 106. Due to the strength inherent in the insulating layer 92, the support 106 can be attached thereto by means such as screws 107 (FIG. 4). The lever handle 104 is connected by pivots 108 and 110 to the support 106 and to the actuation rod 102. When the handle portion 112 of the lever handle 104 is moved to rotate the lever handle 104 about the pivot 108 away from stop 113, the opposite end pivot 110 moves in a semi-circular direction until it engages another stop 115 which motion moves the actuation rod 102 upwardly. At this point, the opposite end 114 of the rod 102 which is pivotally attached to the damper 98 has driven the damper 98 through approximately 90° so that a passage way is clear for smoke and exhaust products from the firebox 24 to flow out the top of the hood 28. The damper 98 is rotatably connected by the damper pivot 101 to its support ring 100 which may include outwardly extending fingers 115 that rest on the top 116 of the hood's insulating layer 92. The weight of the actuation rod 102 and the forces present on the damper 98 are such that the damper 98 tends to remain in either its open or closed condition as determined by the position of the handle 112 against the stops 113 and 115. The stops 113 and 115 control the position of the damper 98, and should any pivotal link fail, it is desired that the damper 98 fall to at least a partially open position. This is accomplished by mounting the damper 98 off center on the pivot 101 so all failure modes cause an open condition of the damper 98.

Figure 8:
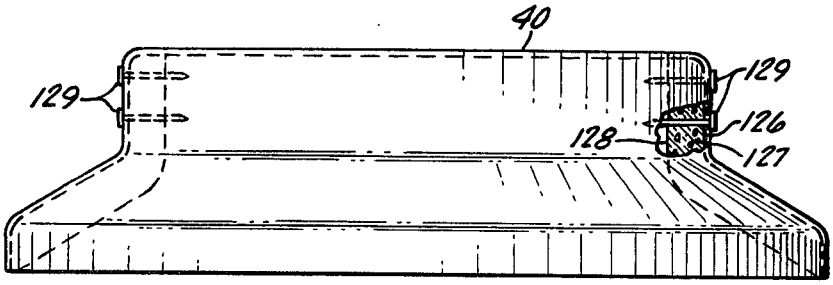
FIG. 8 is a partial cross-sectional view of the ring cap for the lower fireplace of FIG. 1.

Normally, an exhaust pipe 32 or an elbow 30 is connected to the top circular flange 18 of the hood 28. Like the bottom portions 82 of the hood 28, the elbow includes an outer flange portion 120 which extends down over the collar portion 118 of the hood 28 and is connected thereto by suitable bolts or pins 121 or cement. The elbows 30 and the exhaust pipes 32 are of a similar construction as the hood 28 having a magnexium oxychloride-organic resin fiberglass outer shell 124 and an insulating layer of magnesium oxychloride, expanded mica or slag and and microballons. Suitable support means such as straps 124 can be provided to support the elbows 30 and exhaust pipes 32 in any desired position. The straps 124 are connected by screws 125 driven through the surface of the components. As aforesaid, a flashing 38 and storm collar 40 can be provided about the exhaust pipe 32 to protect the home 23 in the area where pipe 32 extends through the roof 34. The flashing 38 is usually a conventional sheet metal structure whereas the storm collar 40 may be molded in a manner similar to the pipe 32 having an outer shell 126 and an inner insulating layer 127 (FIG. 8). The inner surface 128 of the collar 40 is of a diameter to form a relatively snug fit on the outer surface of the pipe 38. Suitable sealant such as the magnesium oxychloride cement and screws 128 can be used to maintain the collar 40 in its proper position on the pipe.

A rain stop 26 can be provided on the upper end of the chimney 26. As shown in FIG. 9, the ceramic rain stops used on tile and masonry fireplaces can be simulated by rain stops 36 having an outer shell 130 and an insulating layer 131 constructed from the same materials and in the same fashion as the pipe 32, the elbow 30 and hood 28. The rain stop 36 is normally bolted to the last section of pipe 32 by means of metal brackets 132. A V-shaped rain deflector member 134 is retained by screws 135 within the rain stop 36 to block the direct path of rain down the pipe 32. When the rain hits the deflector 134, it is deflected off to the side through a center trough 136 which extends beyond the edges of the pipe 32. The rain then drips between the rain stop 36 and the pipe 32. As can be seen, the top 138 is pinched in to assure that any water falling up to 45° with respect to the chimney will not be able to go down the chimney.

The second fireplace 22 is shown in detail in FIG. 10. It, unlike the fireplace 20 which could represent a free-standing fireplace or one that is built into cabinetry, simulates a typical masonry fireplace mounted outside the house 23 on a slab 140. The fireplace 22 is similar to fireplace 20 except that it has decorative outer facing 142 which is molded, dyed, painted, or otherwise marked to simulate a masonry fireplace. The facing 142 is usually constructed like the shells of the other components. As can be seen, the fireplace 22 extends through the house wall 144 and rests on the slab 140. This type of fireplace is particularly convenient to install since all that is required is a small hole in an exterior wall of the house 23 and a slab 140, yet from the inside and outside of the house, a masonry fireplace appears to be present. As shown in detail in FIG. 11, additional facing 146 and hearth 148 can be attached to the facing 48' to further enhance the appearance of a masonry fireplace. Also, an integral metal flashing 149 can be molded into it shell 60' and insulation layer 64' to further ease the problem of installation.

It if is desired to utilize gas logs or a gas starter, a circular notch 150 can be molded into one sidewall sheet 54'. Behind this notch a plug 152 of insulating material can be provided which extends through a hole 154 in the outer shell 60'. When it is desired to install a gas line, all the installer need do is strike the area of the circular noted 150 with a suitable instrument which knocks it and the plug 152 behind it out to form a hole through which a gas line can be extended. When the insulating layer 64' is molded in place, a double concentric plug is used with the outer rig 156 being bonded to the layer 64' during its formation while the plug 152 remains a slip fit inside the ring 156 so it can be driven out.

Figure 12:
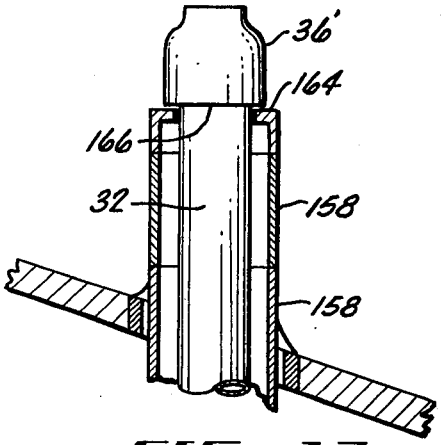
FIG. 12 is a side view of the rain cap arrangement for the fireplace of FIG. 10.

As can be seen in FIG. 10, the simulated sections of masonry chimney 158 connect together as do the exhaust pipes 32'. At the joint 159 therebetween, a support member 160 can be provided which engages pins 162 which assure vertical alignment of the chimney sections 158 and connect the chimney sections 158 to the wall structure as shown. The rain cap 36' as shown in FIG. 12 can also be used on the simulated masonry chimney by merely supporting it so a slight clearance exists between the top 164 of the simulated chimney and the lower edge 166 of the end cap 36. The top 164 of the simulated chimney is sealably attached to the exhaust pipe 32 which runs up thereinside so that the slight clearance provides an escape path for water which would otherwise go down the exhaust pipe 32.

Thus, there has been shown and described novel composite fireplaces which fulfill all of the objects and advantages sought therefor. Many changes, modifications, variations and other uses and applications of the subject invention will, however, become apparent to those skilled in the art after considering this specification together with the accompanying drawings. All such changes, modifications, variations and other uses and applications which do not depart from the spirit and scope of the invention are deemed to be covered by the invention which is limited only by the claims which follow:

What is claimed is:

1. A composite molded fireplace with a firebox and a hood attached to said firebox to conduct exhaust products therefrom, said firebox having:

an inner refractory liner comprised of magnesium oxychloride cement and slate dust;

an outer shell comprised of magnesium oxychloride cement, structural fibers and organic resin; and an insulating layer between said inner liner and said outer shell of magnesium oxychloride cement and inorganic expanded insulation and said hood having:

an outer shell comprised of magnesium oxychloride cement, structural fibers, and organic resins; and an insulating layer within said hood comprised of magnesium oxychloride cement and inorganic expanded insulation.

2. The fireplace defined in claim 1 wherein said inner refractory liner is about 60% slate dust by weight and about 40% magnesium oxychloride cement by weight, said outer shell is comprised of structural fibers and a mixture of about 33% organic resin by weight and 66% magnesium oxychloride cement by weight, and said insulating layer is comprised of at least 25% by weight magnesium oxychloride cement, up to 10% by weight microballons, and the remainder inorganic insulation material chosen from the group consisting of expanded mica and expanded slag.

3. The fireplace defined in claim 2 wherein said organic resin of said outer shell is chosen from the group consisting of polyester resin, epoxy resin and acrylic resin, said acrylic resin being present in quantities up to 5% by weight of said outer shell mixture, said insulating layer when molded including up to 5% by weight cure agent chosen from the group consisting of calcium carbonate, silica flour and magnesium powder, and said refractory liner when molded including up to 2% by weight magnesium powder as an expander.

4. The fireplace defined in claim 1 wherein the outer shell of said hood is comprised of structural fibers and a mixture of about 33% by weight resin chosen from the group consisting of polyester resin, epoxy resin and acrylic resin, said acrylic resin being present in quantities up to 5% by weight of said outer shell mixture, and wherein said insulating layer when molded is comprised of at least 25% by weight magnesium oxychloride cement, up to 10% by weight microballons, up to 5% by weight cure agent chosen from the group consisting of calcium carbonate, silica flour and magnesium powder, and the remainder inorganic insulating material chosen from the group consisting of expanded mica and expanded slag.

5. The fireplace defined in claim 1 wherein said inner refractory liner is comprised of at least one wall sheet and a floor sheet, said sheets having grooved interlocking edges which engage each other, said fireplace having a facing constructed from the same materials as said hood outer shell and shaped to engage the front of said firebox shell, at least two of said refractory sheets and said hood to assist in retaining them together.

6. The fireplace defined in claim 5 wherein said refractory sheets have a predetermined pattern molded therein on the side thereof away from said insulating layer.

7. The fireplace defined in claim 5 wherein at least a portion of said outer shell has a predetermined decorative pattern molded therein on the side thereof away from the insulating layer.

8. The fireplace defined in claim 5 wherein said refractory sheets are adhesively attached to said insulating layer when said insulating layer is molded between said refractory sheets and said outer shell.

9. The fireplace defined in claim 8 wherein at least one of said refractory sheets have a groove molded therein to form a knockout, said outer shell having means to define a hole therethrough in registration with said knockout, said insulating layers having an insulating ring which extends from said knockout to said hole defining means in said outer shell, said insulating ring having an insulating plug therein, whereby said plug and knockout are easily removable for installing a gas line, through said firebox.

10. The fireplace defined in claim 1 wherein said hood has a damper assembly installed therein.

11. The fireplace defined in claim 5 wherein said facing includes an outwardly extending hearth.

12. The fireplace defined in claim 5 including sections of chimney pipe which extend upwardly from said hood; said chimney pipe sections being constructed like said hood having an insulating inner layer and an outer shell.

13. The fireplace defined in claim 12 wherein said outer shell of said chimney pipe sections includes a molded decorative design simulating masonry construction.

14. The fireplace defined in claim 12 including a rain stop attached at the opposite of said chimney pipe sections from said hood.

15. The fireplace defined in claim 1 wherein said magnesium oxychloride cement before molding is the equivalent of between 5 and 6½ pounds of magnesium oxide per gallon of 22° Baume magnesium chloride.

* * * * *